US007422284B2

(12) United States Patent
Hartenstine et al.

(10) Patent No.: US 7,422,284 B2
(45) Date of Patent: Sep. 9, 2008

(54) INFANT SWING SEAT

(75) Inventors: Curtis M. Hartenstine, Birdsboro, PA (US); Gregory Sellers, Christiana, PA (US); Adam Bearup, Shillington, PA (US)

(73) Assignee: Wonderland Nurserygoods Co., Ltd., Neihu, Taipei (TW)

( * ) Notice: Subject to any disclaimer, the term of this patent is extended or adjusted under 35 U.S.C. 154(b) by 371 days.

(21) Appl. No.: 11/282,100

(22) Filed: Nov. 17, 2005

(65) Prior Publication Data

US 2006/0138828 A1 Jun. 29, 2006

Related U.S. Application Data

(60) Provisional application No. 60/631,462, filed on Nov. 29, 2004.

(51) Int. Cl.
*A47D 1/10* (2006.01)

(52) U.S. Cl. ..... 297/250.1; 297/377; 297/440.22; 297/452.15

(58) Field of Classification Search ..... 297/183.4, 297/250.1, 256.16, 281, 373, 377, 411.38, 297/440.22, 452.15; 472/118
See application file for complete search history.

(56) References Cited

U.S. PATENT DOCUMENTS 4,324,432 A 4/1982 Eldon, III et al.
4,325,578 A * 4/1982 Borucki ..... 297/281
4,371,206 A * 2/1983 Johnson, Jr. ..... 297/183.3
4,390,204 A * 6/1983 Fleishman ..... 297/16.1
4,545,613 A * 10/1985 Martel et al. ..... 297/256.13
4,697,845 A * 10/1987 Kamman ..... 297/118
4,805,928 A 2/1989 Nakao et al.
4,858,997 A * 8/1989 Shubin ..... 297/487
4,892,356 A * 1/1990 Pittman et al. ..... 297/452.15
5,102,196 A * 4/1992 Kaneda et al. ..... 297/452.15
5,286,086 A * 2/1994 Gunji ..... 297/250.1
5,593,207 A 1/1997 Turner
6,561,915 B2 5/2003 Kelly et al.

* cited by examiner

*Primary Examiner*—Peter R. Brown
(74) *Attorney, Agent, or Firm*—Martin Fruitman

(57) ABSTRACT

The apparatus is an infant seat that has reduced depth for shipping and recline controls that permit control of the seat during the reclining adjustment. The seat is constructed so that the deepest part of the seat fits into the rest of the seat for packaging, but locks into its proper location for use. The preferred embodiment of the recline control uses a dial on a seat pivot fixture. The dial is pushed in to release the seat for reclining, but the dial is interconnected with the seat so that the dial maintains full control of the seat movement. An alternative recline control captures and releases a support wire at the backside of the seat.

11 Claims, 9 Drawing Sheets

INFANT SWING SEAT

This application claims the benefit of provisional patent application 60/631,462 filed Nov. 29, 2004.

BACKGROUND OF THE INVENTION

This invention deals generally with infant seats and more specifically with an infant seat that has a reduced size for shipping and mechanisms that permit simplified reclining of the seat.

Infant swings are used extensively by caregivers to sooth and comfort babies. They are basically a seat that securely holds and positions the baby within a frame that supports the seat and allows it to move in a swinging front to back or side to side motion relative to the baby.

The seat structures themselves have been constructed in many different ways, including a simple wire frame with a fabric sling and a now common plastic shell with fabric pads. Some seats have a construction for reclining that varies the angle between the seat bottom and seat back, however, most seats provide the recline feature by tilting back the entire seat. In such an arrangement, the angle between the seat bottom and seat back does not change as the seat assembly is reclined, but the angles of both the seat bottom and the seat back relative to the floor are changed.

Many prior art shell type seats pivot the seat for reclining at the junction of the seat bottom and seat back, and they use a support wire and slotted stops to hold the seat upright or in several degrees of tilt. That is, the support wire is held by and pivoted from the swing hanger support rods, and a horizontal section of the wire is held within downward opening hook-like fixtures on the outside of the seat back. This arrangement has proven to be both cost effective and structurally sound, but it results in a recline system that is not visible from the front of the seat. Therefore, it requires the caregiver to use two hands while standing behind the swing or reach around the seat in order to adjust the seat angle. Typically, one hand is needed to support the seat while the other hand repositions the support wire.

Another problem with the shell type seats is their substantial shipping size. Prior art plastic shell seats are big and bulky causing the shipping size of even the disassembled infant swing to be rather large.

It would be very beneficial to have an infant seat that provides a simple operation for changing the recline position, while also minimizing the tendency of a seat occupied by a child to tilt over backwards when the angle of recline is being changed. Another beneficial improvement would be a structure permitting grasping handles on both sides of the seat to rotate the entire seat to the desired position. Furthermore, substantial economic benefit could be derived from a shell type seat design that would reduce the shipping size of the seat.

SUMMARY OF THE INVENTION

The preferred embodiment of the present invention reduces the size of the seat for shipping by constructing it in two mating parts. The complete seat includes a seat bottom connected to a seat back in a fixed angle and two side walls that all meet to form a basket-like support for the infant, and it is the depth of this "basket" that makes the seat bulky. The seat of the preferred embodiment is built with a base segment shaped as a ring that includes parts of the seat bottom, seat back, and the two side walls. The base segment has a larger access opening at one edge of the ring and a smaller junction opening at the other edge of the ring. The second part of the seat is a junction segment shaped as a concave structure with an exposed edge and forming the confluence of the seat bottom, the seat back, and the two sides. The exposed edge of the junction section mates with the junction opening of the base segment at a junction line to form a complete basket shape.

The preferred embodiment reduces the bulk by permitting the bottom of the basket, along with a portion of all the sides around the basket bottom, to be shipped within the rest of the basket and to be moved and locked into place for use. Both the junction segment and the base segment of the structure include parts of the seat bottom, seat back, and both sides. Therefore, the structural rigidity of both segments is maintained because they both have continuous structure all the way around. Furthermore, the junction section has the added strength of the surface joining the seat bottom, seat back, and sides, and the base segment has a front leg rest and a rolled edge around the large access opening that contribute to the rigidity of that segment.

The two segments of the preferred embodiment are held together by a hinge in the seat back and interlocking tabs and slots around the curved junction line between them. Several of the tabs have catches formed into them that lock the tabs into their matching slots so that the junction segment can not inadvertently be separated from the base segment. The asymmetrical shapes of the segments also make it impossible for them to be improperly assembled. For the safety and comfort of the infant within the seat it is advisable to construct the junction segment with the tabs and the base segment with the slots, thus assuring that the tabs do not protrude into the space occupied by the infant.

The safety of the infant within the seat is also a consideration in the design of the reclining mechanism of the preferred embodiment of the invention. Rather than tilt the seat around an axis at the junction of the seat bottom and the seat back, the preferred embodiment uses pivot fixtures attached on the seat side walls, and the pivot fixtures are located significantly above the junction of the seat bottom and the seat back. This places the pivot points very close to the center of gravity of the infant occupying the seat and greatly facilitates the ease of reclining the child, because the child is nearly balanced on the recline axis. The design therefore reduces the tendency of the seat to tilt over backwards while a caregiver is adjusting the recline angle of the seat.

Another safety feature of the invention is a mechanism that allows the caregiver to grasp the pivot control mechanism with two hands and directly rotate the seat with the pivot control thereby maintaining a firm grasp on the seat. This mechanism permits the caregiver to completely control the seat and assure that the seat and the infant do not move too far. In the preferred embodiment, the recline angle is controlled by dials located on the pivot fixtures of the seat. The caregiver needs only to push the dials in toward the seat to disengage the seat from a fixed outer housing attached to the swing frame and to then turn the dials, which are still attached to the seat, to set the seat at a desired angle. Releasing the dials, which are spring operated, locks the seat into the angle which has been selected.

An alternate embodiment is a one hand operated recline angle control that uses a wire support sliding within slots on the backside of the seat back. The several positions of reclining are determined by a locking fixture that has spaced indentations interacting with the wire support. The locking fixture is released by the caregiver's hand while also holding the top of the seat back. Releasing the locking fixture with the same hand that is holding the seat back releases the wire support from the locking fixture so that the caregiver can adjust the seat's angle while safely holding the seat back.

The present invention thereby solves several problems that have plagued swing seats. It provides a seat design that reduces the shipping size of the seat thus yielding reduced shipping costs, and it furnishes recline angle adjustment mechanisms that permit a caregiver to safely adjust the recline angle while maintaining control of the seat to assure that the infant within the seat is not displaced.

DETAILED DESCRIPTION OF THE INVENTION

Figure 1:
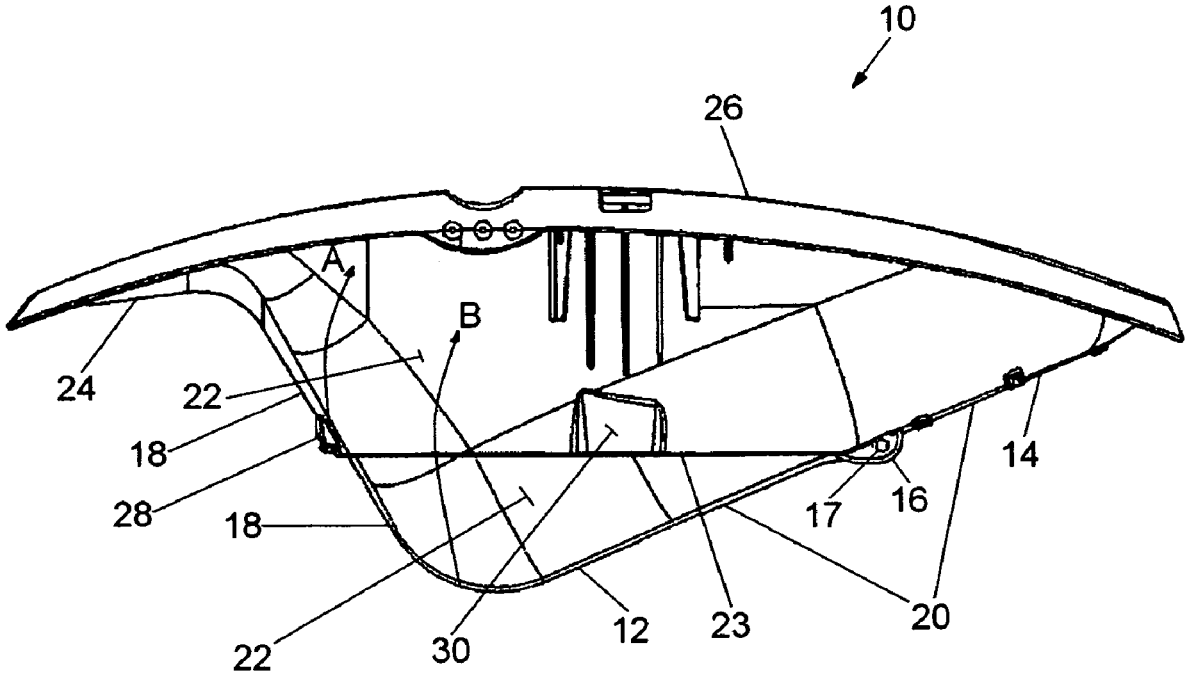
FIG. 1 is a side view of the preferred embodiment of the invention showing an infant seat assembled from two mating segments.

FIG. 1 is a side view of the preferred embodiment of the invention showing infant seat 10 assembled from two mating segments, junction segment 12 and base segment 14. Infant seat 10 is built with base segment 14 shaped as a ring that includes parts of the seat bottom 18, seat back 20, and two side walls 22. Base segment 14 has a larger access opening at outer edge 26 of the ring and a smaller junction opening at the inner edge of the ring. The second part of the seat is junction segment 12 shaped as a concave structure with an exposed edge and forming the confluence of seat bottom 18, seat back 20, and side walls 22. The exposed edge of junction section 12 mates with the inner opening of base segment 14 at junction line 23 to form a continuous basket shape.

Junction segment 12 is held within base segment 14 by hinge 16, hinge pin 17, and locking tabs 28 and 30. Together junction segment 12 and base segment 14 completely form seat bottom 18, seat back 20, and side walls 22 (only one of which is seen in FIG. 1). Leg support 24 and rolled outer edge 26, both of which add structural strength to base section 14, are also shown in FIG. 1.

Infant seat 10 is shipped from the manufacturer with junction segment 12 attached to base segment 14 only at hinge 16. To reduce the shipping size, junction segment 12 in pivoted up into base segment 14 as indicated by arrows A and B when packaged. Assembly requires only that junction segment 12 be pivoted down from within base segment in the opposite direction from arrows A and B, and locking tabs 28 and 30 be inserted into their matching slots within base section 14.

Figure 2:
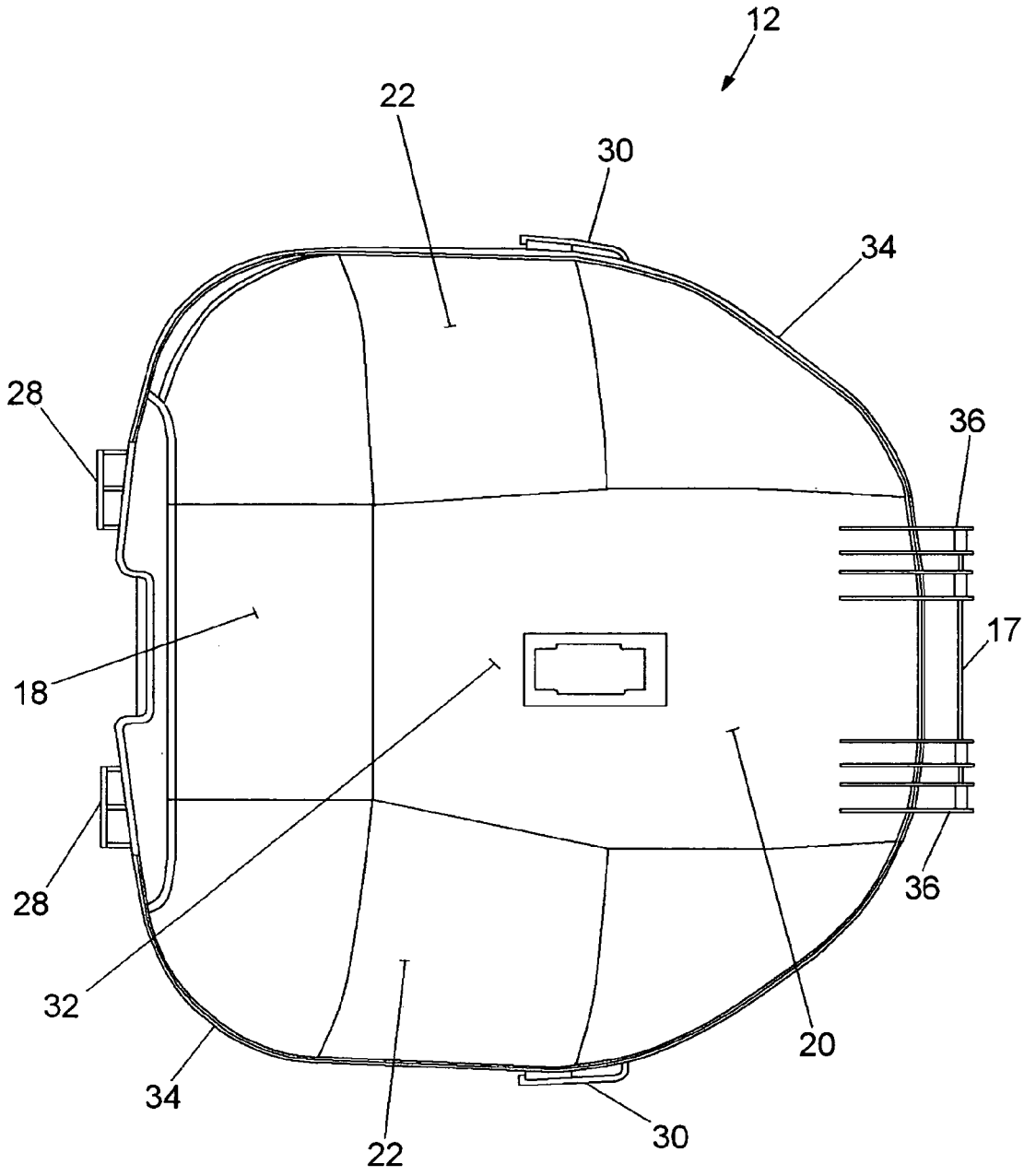
FIG. 2 is a top view of the junction segment of the infant seat of FIG. 1.
Figure 3:
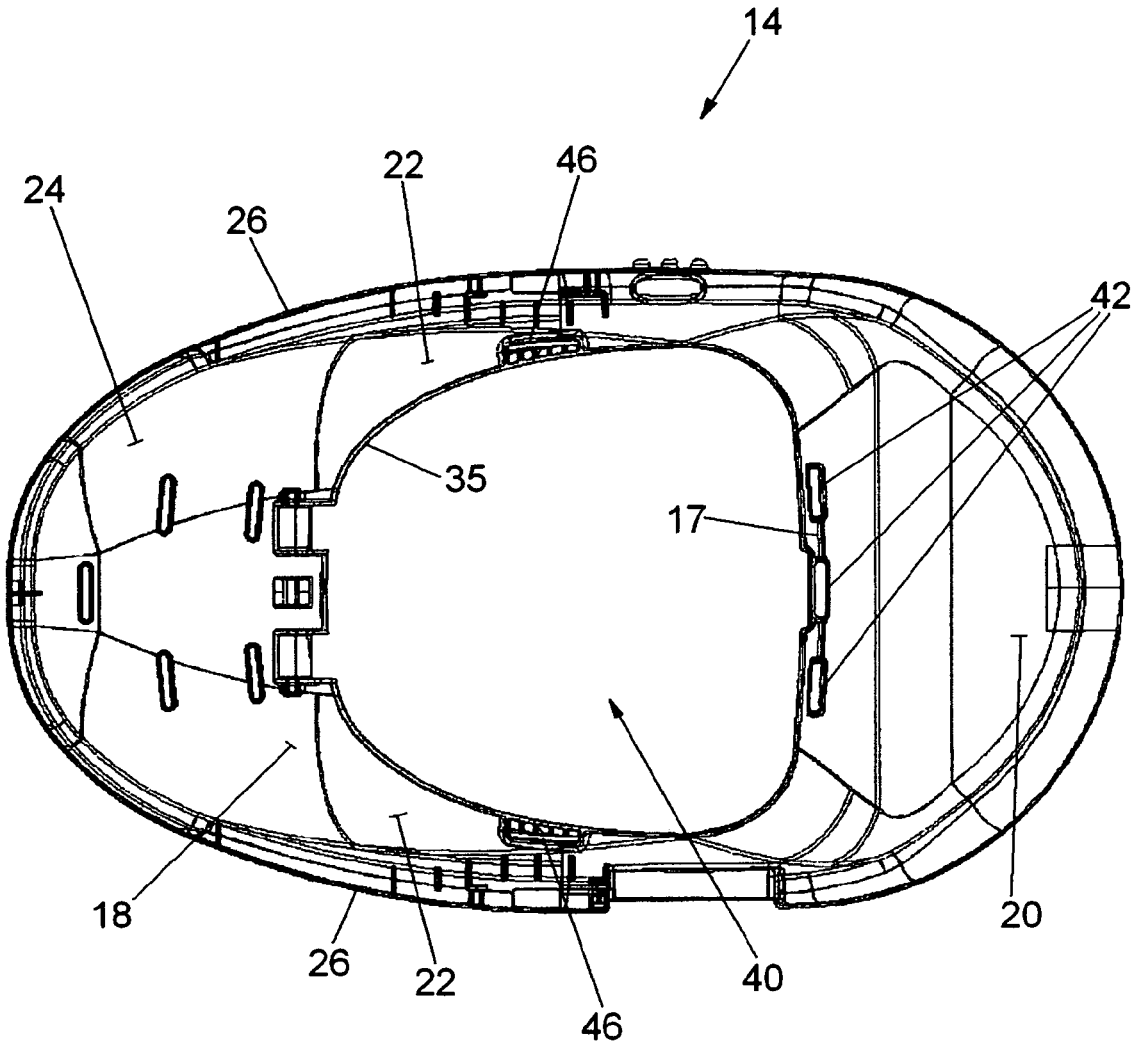
FIG. 3 is a top view of the base segment of the infant seat of FIG. 1.

FIG. 2 is a top view of junction segment 12 of infant seat 10 of FIG. 1, and it should be appreciated that in this view junction segment 12 is a concave surface, a dish shape with center portion 32 more remote than exposed edge 34. Exposed edge 34 is shaped to match with inner edge of 35 of base section 14 (FIG. 3). Seat bottom 18, seat back 20, and sidewalls 22 all merge within junction segment 12 and are indicated to facilitate orientation with FIG. 1. Hinge fixtures 36 are formed on junction segment 12 to capture hinge pin 17 of hinge 16 (FIG. 1), which is also captured by complementary hinge fixtures on base segment 14. Front locking tabs 28 and side locking tabs 30 insert into matching tab slots 44 and 46 in base segment 14 (FIG. 3) to lock junction segment 12 within base segment 14. Locking tabs 28 and 30 can be constructed with conventional arrowhead type ends so that once inserted and snapped into their matching slots, the tabs will not inadvertently move out.

FIG. 3 is a top view of base segment 14 of infant seat 10 of FIG. 1. As with junction segment 12 of FIG. 2, in this view base segment 14 is also a concave surface, a dish shape, but it has center hole 40 with inner edge 35 into which exposed edge 34 of junction segment 12 fits when the two segments are assembled together. Seat bottom 18, seat back 20, and sidewalls 22 are indicated to facilitate orientation with FIG. 1. Hinge fixtures 42 are formed on base segment 14 to capture hinge pin 17 of hinge 16 (FIG. 1). Hinge pin 17 is also captured by complementary hinge fixtures 36 on junction segment 12, and together they form hinge 16 of FIG. 1. Front locking tabs 28 and side locking tabs 30 of junction segment 12 insert into matching tab slots 44 and 46 of base segment 14 to lock junction segment 12 within base segment 14. Other features such as slots and holes are visible on both junction segment 12 and base segment 14, but they are not pertinent to the present invention. Such other features are typically present to hold padding and safety belts.

Figure 4:
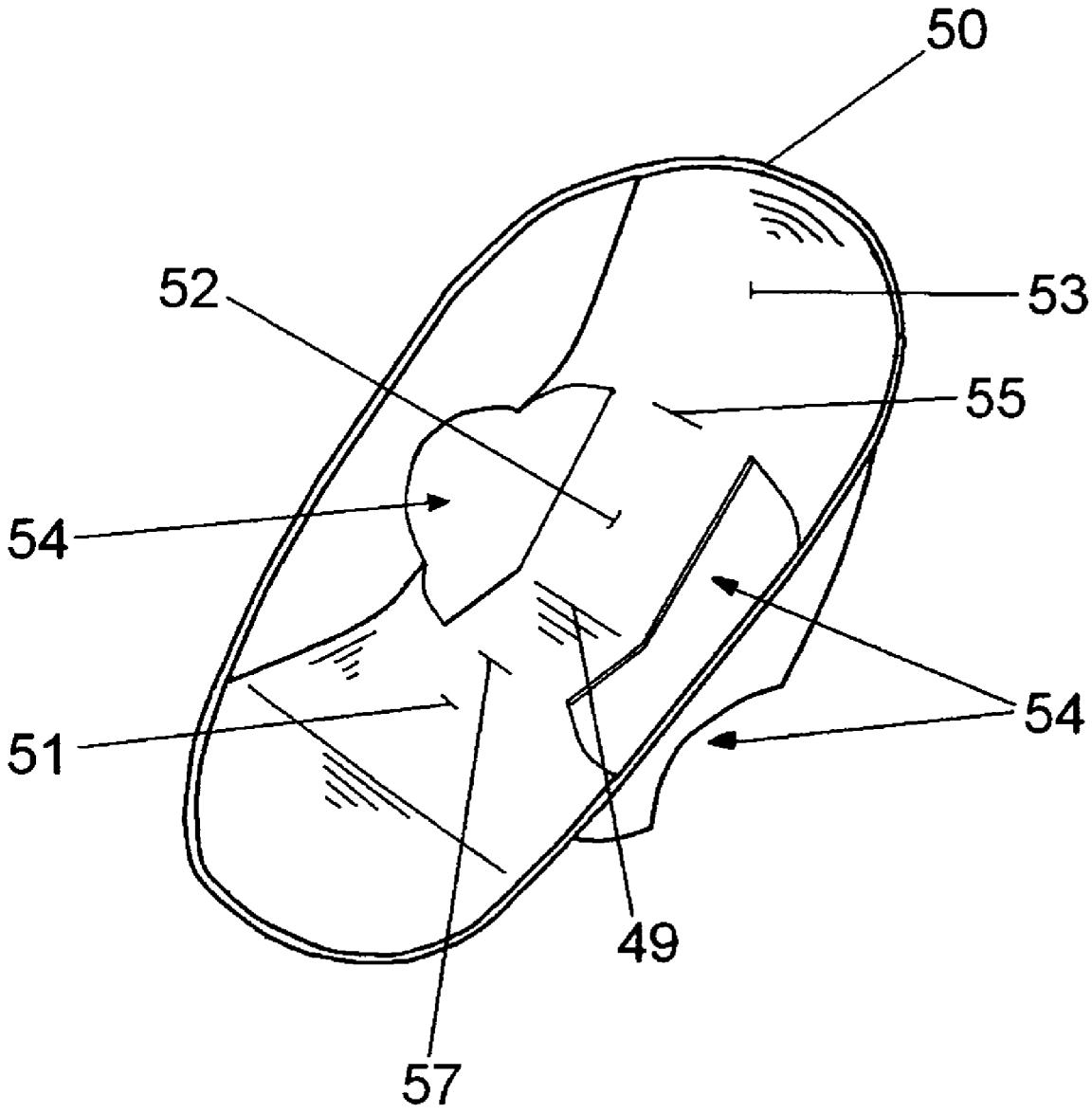
FIG. 4 is a perspective view of an alternate embodiment of the invention showing an infant seat with a flexible support strap.
Figure 5:
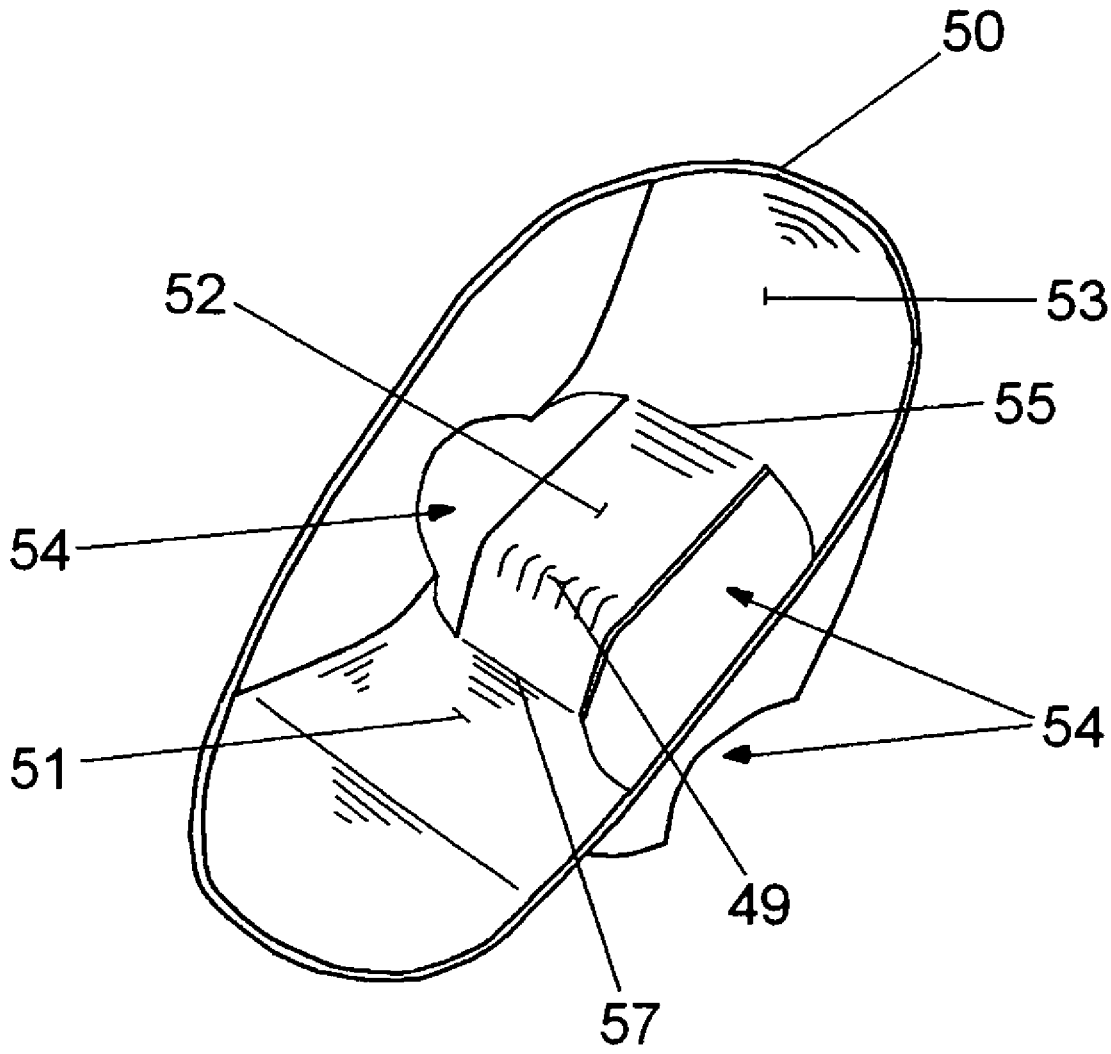
FIG. 5 is a perspective view of the alternate embodiment of the infant seat of FIG. 4 with the flexible support strap pushed back within the infant seat.

FIG. 4 is a perspective view of an alternate embodiment of the invention showing infant seat 50 with a flexible support strap 52 in place, and FIG. 5 is a perspective view of the same infant seat 50 of FIG. 4 showing support strap 52 pushed back within infant seat 50. FIG. 4 shows infant seat 50 as it looks when in use, with support strap 52 forming the junction between seat bottom 51 and seat back 53, however, for clarity no accessories or reclining mechanisms are shown in FIG. 4. Infant seat 50 has a side profile very similar to assembled infant seat 10 of FIG. 1, so that, as shown in FIG. 4 it has the classic problem of a large depth dimension that requires expensive packaging and shipping.

However, infant seat 50 is formed without the conventional full junction segment as shown in FIGS. 1 and 2. Instead, the junction region, the region which is closest to the confluence of the seat bottom, seat back, and sides, is constructed with flexible support strap 52 and open holes 54 on both sides of support strap 52. Furthermore, support 52 can be constructed of flexible plastic with reduced thickness at regions 49, 55, and 57 to form flexible hinges of thin solid material. This is the same type of plastic that is conventionally used for plastic hinges, and it has exceptional strength and long life.

Such a plastic hinges and the structure of strap 52 make it possible to store strap 52 within infant seat 50 for shipping by simply pushing strap 52 back into the enclosed volume of infant seat 50 as shown in FIG. 5. Then, when putting infant seat 50 into service it is only necessary to push strap 52 outward and it moves into the position shown in FIG. 4. This simple structure makes it possible to reduce the depth of infant seat 50 for shipping, and provides substantial economies in packaging and shipment.

Figure 6:
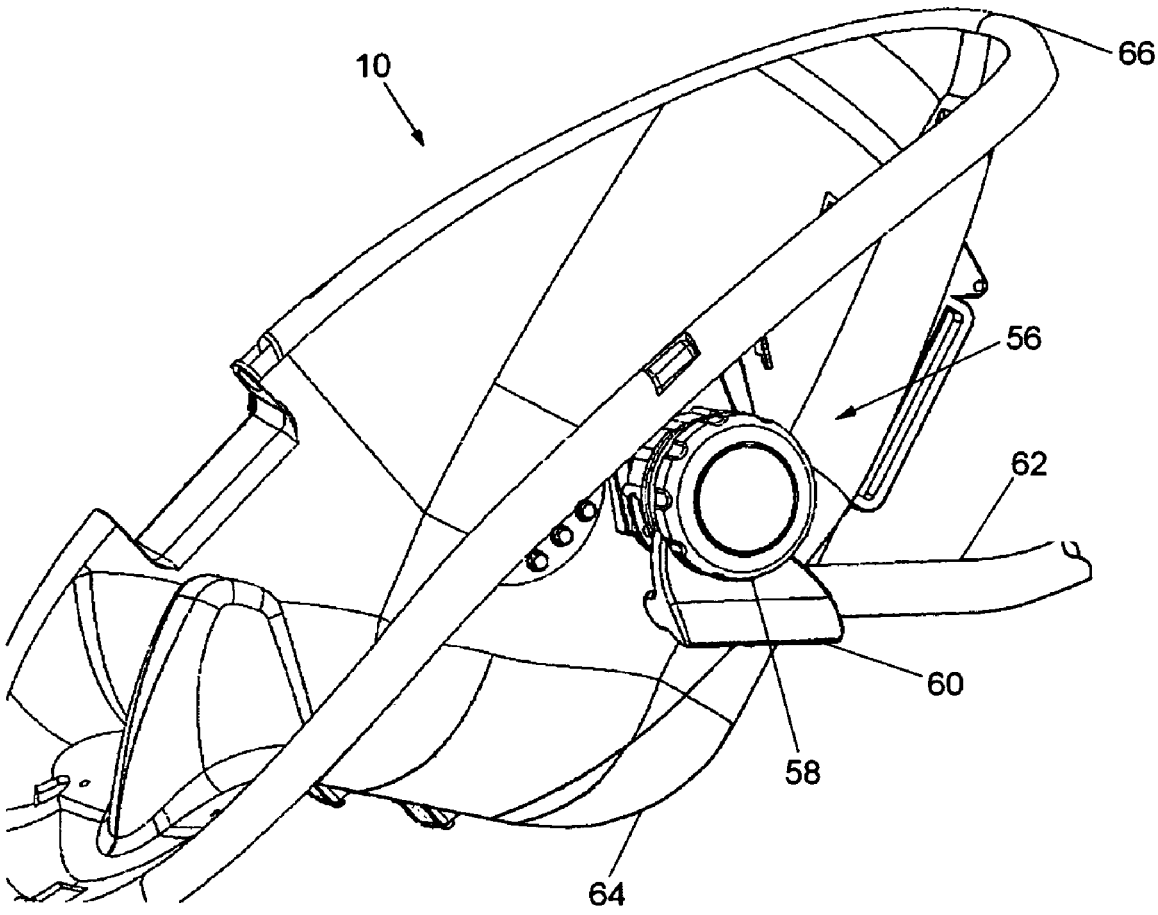
FIG. 6 is a perspective view of an infant seat with the dial recline angle adjustment assembly of the preferred embodiment.

FIG. 6 is a perspective view of infant seat 10 with one of two recline adjustment assemblies 56 of the preferred embodiment. The second adjustment assembly 56 is on the opposite side of seat 10. Adjustment assembly 56 permits a caregiver to simply push both dials 58 in toward infant seat 10, which disengages infant seat 10 from outer housings 60 that are permanently attached to support tube 62. The caregiver can then rotate seat 10 with dials 58 to a desired position relative to support tube 62. Releasing dials 58, which are spring operated, locks the seat into the recline angle which has been selected but maintains the interconnection between seat 10 and dials 58.

The location of adjustment assemblies 56 in the preferred embodiment of the invention also improves the safety of the infant within seat 10. Rather than pivot the seat unstably around an axis at junction 64 of the seat bottom and the seat back as in the prior art, the preferred embodiment locates adjustment assembly 56 and a similarly located pivot fixture (not shown) on the other side of infant seat 10 above junction 64 by a distance of at least 2 inches above seat bottom 18 (FIG. 1) and one inch inward from set back 20 (FIG. 2). This places the pivot points at or very close to the center of gravity of the infant occupying the seat and greatly reduces the tendency of infant, seat 10 to tilt over backwards while a caregiver is adjusting the recline angle of the seat.

Figure 7A:
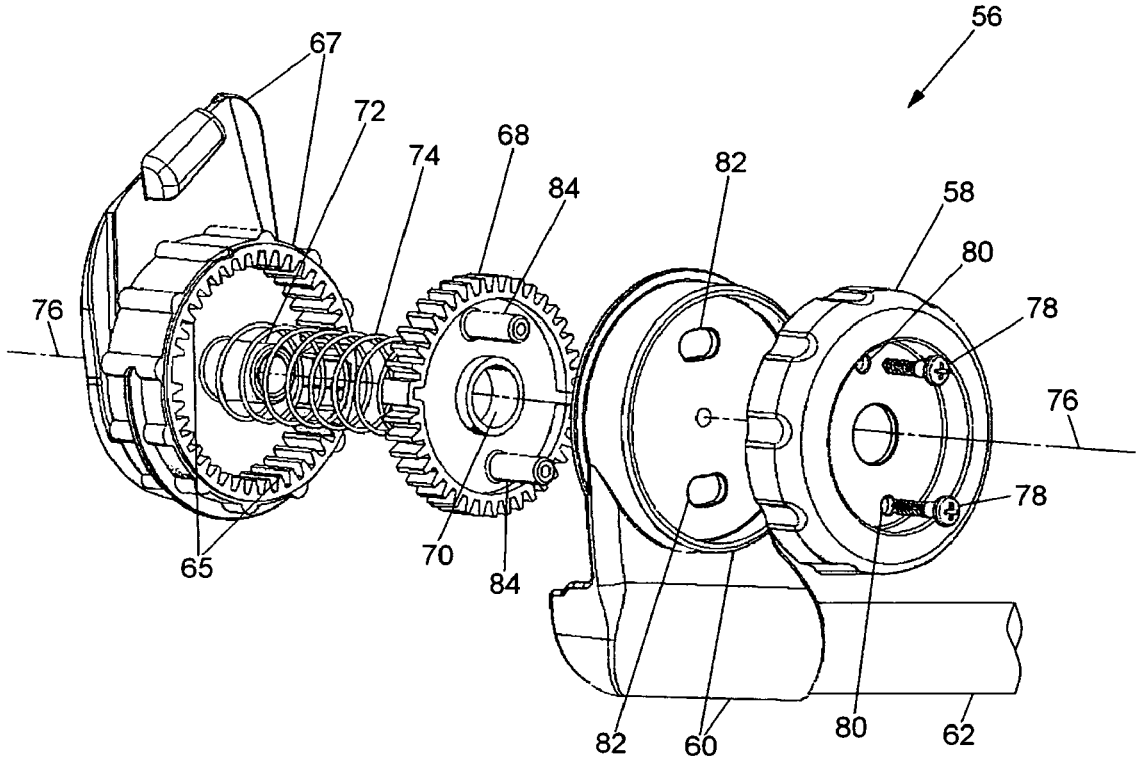
FIG. 7A is an exploded perspective view of the preferred embodiment of the dial recline angle adjustment assembly of FIG. 6.
Figure 7B:
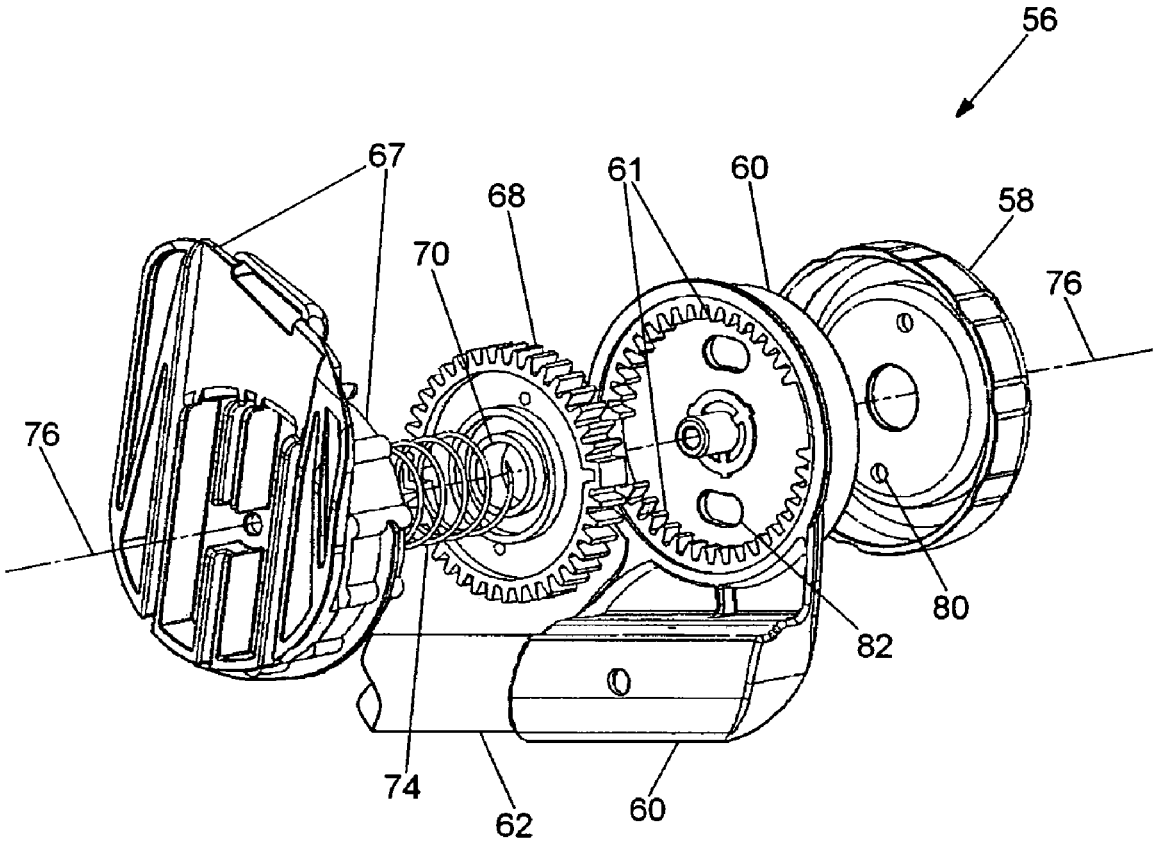
FIG. 7B is an exploded perspective view of the preferred embodiment of the dial recline angle adjustment assembly from the opposite side shown in FIG. 7A.

FIG. 7A is an exploded perspective view of the preferred embodiment of one recline adjustment assembly 56 from the same direction as seen in FIG. 6, and FIG. 7B is an exploded perspective view of recline adjustment assembly 56 from the opposite side that is shown in FIG. 7A. The explanation which follows is best understood by referring to both FIGS. 7A and 7B.

Outer housing 60 is permanently attached to support tube 62 of the swing frame and is therefore fixed in place relative to the floor or ground (not shown) upon which support tube 62 rests. Inner housing 67 is attached to and pivots with infant seat 10. Outer housing 60 includes stationary ring gear 61 with inner facing teeth, and inner housing 67 includes pivot ring gear 65 which is identical to ring gear 61. Control gear 68 is located between stationary gear 61 and pivot gear 65, and includes axial hole 70 that fits over and rotates around spindle 72 on inner housing 67. When adjustment assembly 56 is fully assembled, control gear 68 engages within stationary gear 61 and partially within pivot gear 65, and is held within stationary gear 61 by compression spring 74. This position of control gear 68 locks stationary ring gear 61 and pivot gear 65 together into the same rotational position and thereby locks inner housing 67 and seat 10 into a fixed position relative to outer housing 60 and support bar 62.

It is the function of dial 58 to temporarily unlock pivot gear 65 from stationary gear 61 and to implement the rotation of seat 10 around axis 76 which is common to all the parts. For this purpose, dial 58 is rigidly connected to control gear 68 by screws 78 that pass through holes 81 in dial 58 and holes 82 in outer housing 60 and screw into sleeves 84 on control gear 68. Dial 58 can then be pushed toward seat 10 and pushes control gear 68 farther into inner housing 67 and out of contact with stationary gear 61 that is within outer housing 60. This frees up inner housing 67 and seat 10 for movement but maintains the connection with dial 58, so that seat 10 moves in the direction in which dial 58 is rotated. When dial 58 is released, spring 74 pushes control gear 68 back into outer housing 60 and locks seat 10 in the new position into which it has been rotated.

This simple operation of recline adjustment assembly 56 permits the caregiver to adjust the angle of recline of seat 10 by simply releasing the recline mechanism and rotating the mechanism and the seat with both hands. The seat rotates easily because it is at approximately the center of gravity of the seat whether the seat is or is not occupied. Recline seat adjustment assembly 56 can also be installed on only one side of seat 10, but using assemblies 56 on both sides of seat 10 provides more stability.

Figure 8:
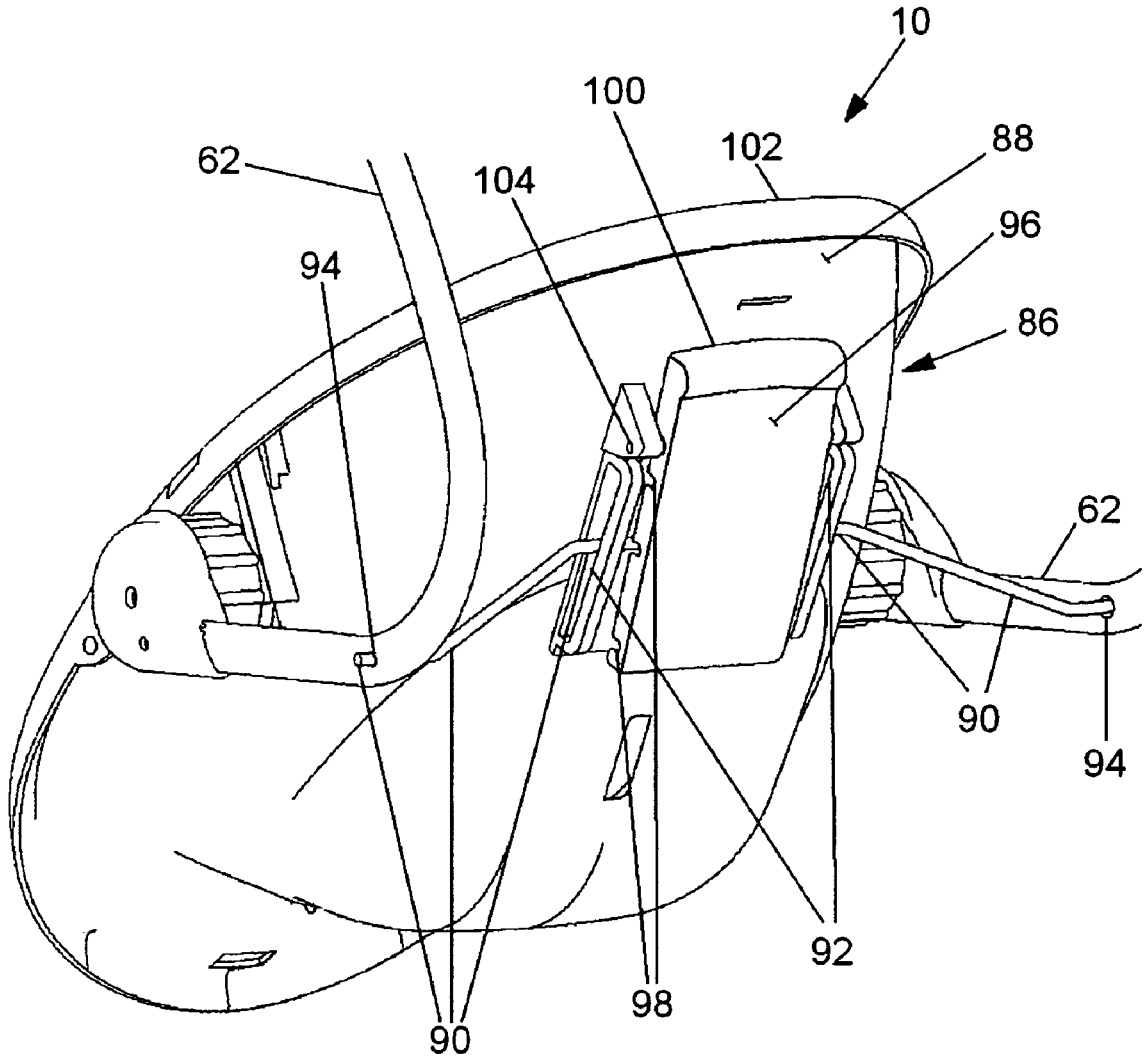
FIG. 8 is a perspective view of an alternative embodiment of a one hand operated recline angle adjustment assembly.

FIG. 8 is a perspective view of an alternative embodiment of one hand operated recline control assembly 86 which is located on outside back surface 88 of seat 10. Recline control assembly 86 captures and locks wire support 90 which slides within slots 92 formed on the back surface 88 of seat 10. Slots 92 are oriented in a vertical plane, and wire support 90 is attached to support tubes 62 by insertion into holes 94 within which wire support 90 is free to pivot. Wire support 90 therefore supports seat 10 at different recline angles depending upon the position of wire support 90 within slots 92.

The several recline positions of seat 10 are determined by locking fixture 96 that has spaced indentations 98 to capture wire support 90 at different angular positions. In operation, top 100 of locking fixture 96 is grasped by the caregiver's hand while simultaneously holding top 102 of seat back 88. Squeezing top 100 of locking fixture 96 toward top 102 of seat back 88 pivots locking fixture 96 on pivot points 104 and releases wire support 90 from within whichever indentation 98 is capturing it. The caregiver can then adjust the angle of seat 10 while safely holding top 102 of the seat. Upon the release of top 100 of locking fixture 96 a spring (not shown) between locking fixture 96 and back surface 88 of seat 10 pivots locking fixture 96 into position against the seat's back surface to lock support wire 90 into the appropriate indentation.

Recline control assembly 86 thereby furnishes multiple angles for reclining seat 10 while always maintaining control of seat 10 during the adjustment procedure and freeing up the caregiver's other hand to assure the safety of the infant within the seat.

The present invention provides several solutions to problems that have plagued swing seats. It provides seat designs that reduce the shipping size of the seat thus yielding reduced shipping costs, and it furnishes recline angle adjustment mechanisms that permit a caregiver to safely adjust the recline angle while maintaining full control of the seat to assure that the infant within the seat is not displaced.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the specific shapes of seat 10, junction segment 12 and base segment 14 can be changed, and the locations of hinge 16 and locking tabs 28 could be interchanged or more or different types of locking tabs could be installed at other locations. Furthermore, recline control assembly 86 can be constructed to use actions other than a squeezing motion.

What is claimed as new and for which letters patent of United States are desired to be secured is:

1. An infant seat (10) formed with a fixed angle between a seat bottom (18) and a seat back (20) and with two generally perpendicularly extending side walls (22) joined to and extending between the seat bottom (18) and the seat back (20), comprising:

a base segment (14) shaped as a ring, including parts of the seat bottom (18), seat back (20), and the two side walls (22), and with a larger access opening at an outer edge (26) of the ring and a smaller junction opening at an inner edge of the ring;

a distinct junction segment (12) shaped as a concave structure with an exposed perimetrical edge (34) and forming the confluence of the seat bottom (18) the seat back (20) and the two side walls (22), with the exposed edge (34) of the junction segment (12) shaped to be mated with the inner edge of the ring of the base segment (14) at a junction line (23) to form a continuous basket shape.

2. The infant seat of claim 1 further including a hinge (16), with the hinge (16) interconnecting the base segment (14) and the junction segment (12) and enabling the junction segment (12) to pivot into the base segment (14).

3. The infant seat of claim 1 further including a hinge (16), with the hinge (16) interconnecting the base segment (14) and the junction segment (12) and enabling the junction segment (12) to pivot into the base segment (14) and also including at least one locking device (28,30) to lock the junction segment (12) to the base segment (14).

4. An infant seat (50) formed with a fixed angle between a seat bottom (51) and a seat back (53) and with two generally perpendicularly extending side walls joined to and extending between the seat bottom (51) and the seat back (53), comprising: a flexible support strap(52) forming the junction of the seat bottom (51) and the seat back (53) and also including parts of the seat bottom (51) and the seat back (53), and with the support strap (52) constructed to permit the support strap (52)to be pushed back into the space between the side walls to reduce the size of the infant seat for shipping.

5. An infant seat recline angle control apparatus 56 comprising:

pivot fixtures (67) attached to an infant seat (10). so that the infant seat (10) rotates with the pivot fixtures (67);

at least one dial (58) interconnected with the infant seat (10) by a coupling that is concentric with an axis (76) common to the dial (58) and to at least one pivot fixture (67);

a locking device (68) that interconnects a pivot fixture (67) and the dial (58) to a fixed support structure (60), with the locking device (68) preventing the pivot fixture (67) and the dial (58) from rotating when the locking device (68) is engaged with the support structure (60);

a biasing apparatus (74) that holds the locking device (68) engaged with the support structure (60);

a release structure interconnected with the dial (58) and operable by grasping the dial (58), with operation of the release structure counteracting the biasing apparatus (74) and disengaging the locking device (68) from the support structure (60) so that the dial (58) and the infant seat (10) can be rotated to adjust the recline angle of the seat; and wherein the locking device comprises:

a control gear (68);

a pivot gear (65) attached to the pivot fixture (67) with which the infant seat (10) rotates, with the pivot gear (65) contacting and interacting with the control gear (68); and a stationary gear (61) attached to the support structure (60), with the stationary gear (68) interacting with the control gear (68); and with the biasing apparatus (74) holding the control gear (68) engaged with both the pivot gear (65) and the stationary gear (61), and operation of the release structure disengages the control gear (68) from the stationary gear (61).

6. The infant seat recline angle control apparatus of claim 5 wherein the control gear (68) is moveable along the dial axis (76), and the release structure is a mechanism (78, 84) which interconnects the dial (58) to the control gear (68) and mounts the dial (58) to slide along the dial axis (76) and push the control gear (68) out of engagement with the stationary gear (61).

7. An infant seat recline angle control apparatus comprising;

an infant seat with two sides, a back with a top and an outside back surface, and pivot fixtures that rotate, so that the infant seat rotates with the pivot fixtures, and with the infant seat supported from a support surface by support structures;

at least one slot interconnected with the outside back surface of the infant seat;

a wire support pivoting within holes in the support structures with a portion of the wire support captured by and slidable within the at least one slot, and with the wire support supporting the seat at different recline angles when the wire is at different locations along the at least one slot;

a locking fixture interconnected with the seat's outside back surface;

spaced indentations within the locking fixture, with the indentations oriented to capture the support wire at different positions along the at least one slot; and a release control on the locking fixture that moves the indentations away from the wire to release the wire for changing positions along the at least one slot.

8. The infant seat recline angle control apparatus of claim 7 wherein the locking fixture is pivotable and moving a portion of the locking fixture releases the captured support wire.

9. The infant seat recline angle control apparatus of claim 7 wherein the locking fixture is pivotable and pressing the portion of the locking fixture nearest to the top of the seat back releases the captured support wire.

10. The infant seat recline angle control apparatus of claim 7 wherein the locking fixture is located so that it can be controlled while simultaneously holding the seat back.

11. The infant seat recline angle control apparatus of claim 7 wherein the pivot fixtures are attached to the two sides at a location at least 2 inches above the seat bottom and at least 1 inch inward from the seat back.

* * * * *